United States Patent [19]

Adkins

[11] 4,224,683

[45] Sep. 23, 1980

[54] MULTIPLE-CHANNEL ACOUSTO-ELECTRIC CONVOLVER

[75] Inventor: Larry R. Adkins, Tustin, Calif.

[73] Assignee: Rockwell International Corporation, El Segundo, Calif.

[21] Appl. No.: 937,630

[22] Filed: Aug. 25, 1978

[51] Int. Cl.[3] ..... G06G 7/195

[52] U.S. Cl. ..... 364/821; 310/313 R; 333/150; 333/154; 364/861

[58] Field of Search ..... 364/821, 861; 310/313, 310/151; 333/150, 154, 193, 195

[56] References Cited

U.S. PATENT DOCUMENTS

| | | | |
|---|---|---|---|
| 3,770,949 | 11/1973 | Whitehouse et al. | 364/821 |
| 3,942,140 | 3/1976 | Laker et al. | 333/193 |
| 3,983,517 | 9/1976 | Weglein | 333/195 |
| 4,016,513 | 4/1977 | Solie | 333/154 |
| 4,016,514 | 4/1977 | Reeder et al. | 333/150 |
| 4,041,419 | 8/1977 | Desormiere et al. | 364/821 |
| 4,054,851 | 10/1977 | Borner et al. | 333/195 |
| 4,065,735 | 12/1977 | Palfreeman et al. | 333/195 |
| 4,066,984 | 1/1978 | Stern et al. | 333/151 |
| 4,070,652 | 1/1978 | Heng et al. | 333/150 |
| 4,081,769 | 3/1978 | Shreve | 333/195 |
| 4,099,146 | 6/1978 | De Vries | 364/821 |
| 4,114,116 | 9/1978 | Reeder | 364/821 |

FOREIGN PATENT DOCUMENTS

| | | | |
|---|---|---|---|
| 509977 | 9/1976 | U.S.S.R. | 310/313 |

OTHER PUBLICATIONS

In Re Harza, 124 USP2 379.

*Primary Examiner*—Felix D. Gruber
*Attorney, Agent, or Firm*—H. Fredrick Hamann; Richard A. Bachand; Gilbert H. Friedman

[57] ABSTRACT

An acousto-electric convolver having a relatively long effective interaction region for counter-propagating surface acoustic waves and, therefore, a relatively large time-bandwith product implemented by distributing a coupler, such as a multistrip coupler or an array of interdigital transducer taps, over a plurality of parallel-connected single-channel acousto-electric convolvers.

8 Claims, 2 Drawing Figures

MULTIPLE-CHANNEL ACOUSTO-ELECTRIC CONVOLVER

The invention herein described was made in the course of or under a contract or subcontract thereunder, with the U.S. Army.

BACKGROUND OF THE INVENTION

1. Field of the Invention

The present invention relates generally to acousto-electric, or space-charge-enhanced, convolvers and more particularly to acousto-electric convolvers having a plurality of channels wherein the coupler means for sensing electric fields associated with counter-propagating surface acoustic waves is distributed over the plurality of channels.

2. Description of the Prior Art

The operation of acousto-electric, or space-charge-enhanced, convolvers may be based, for example, on the nonlinear interaction of electric fields generated by oppositely directed surface acoustic waves counter-propagating on a piezoelectric film or substrate with charge carriers in a layer or wafer of semiconductor material or on nonlinear signal mixing in a chain of semiconductor diodes.

Earlier devices of this type employ a piezoelectric substrate of lithium niobate and a wafer of silicon spaced above the acoustic beam, or propagation path for the acoustic waves, on the substrate. The air gap spacing between the piezoelectric substrate and the silicon wafer is on the order of 1000 angstroms. For a discussion of such devices see, for example, G. S. Kino, W. R. Shreve, and H. R. Gautier, "Parametric Interactions of Rayleigh Waves," 1972 *Ultrasonic Symposium Proceedings,* IEEE Cat. No. 72 CHO 708-8SU, pages 285–287 and J. M. Smith, E. Stern, and Abraham Bers, "Accumulation-Layer Surface-Wave Convolver," *Electronics Letters,* Vol. 9, No. 6, Mar. 22, 1973, pages 145–146. In the air-gap convolvers discussed in the above-referenced articles, the output signal is sensed across a pair of electrodes, one on the outer or top surface of the semiconductor wafer and one on the bottom or outer surface of the piezoelectric substrate.

A major disadvantage of air-gap convolvers is that a configuration which requires a semiconductor wafer to be precisely and uniformly spaced across an air gap from a piezoelectric substrate is difficult and expensive to manufacture in quantity to the tolerances required for consistent results. However, if the semiconductor wafer is placed in direct contact with the piezoelectric substrate, it interferes with the propagation of surface acoustic waves thereon.

Therefore, interest has focused on the utilization of arrays of interdigital transducer taps and on multistrip couplers. Multistrip couplers are arrays of parallel closely spaced narrow strips of conductor material disposed on the surface of a piezoelectric surface acoustic wave propagation medium perpendicular to the wave vectors. The multistrip coupler spans the interaction region, or propagation path, and extends outward therefrom. Such a multistrip coupler is described in F. G. Marshall and E. G. S. Paige, "Novel Acoustic-Surface-Wave Directional Coupler with Diverse Applications," *Electronics Letters,* Vol. 7, No. 16, Aug. 12, 1971, pages 460–462. A multistrip coupler may be used to couple the normal components of electric fields associated with surface acoustic waves propagating on a piezoelectric film on a substrate to an adjacent region of the same substrate or to a similar distinct substrate. A strip of semiconductor material can then be placed in contact with the multistrip coupler outside the acoustic beam without interfering with the surface acoustic waves. A multistrip coupled convolver having a silicon chip with a thin silicon dioxide coating of controlled thickness pressed into mechanical contact with the coupling strips of the multistrip coupler is described in W. R. Shreve and G. S. Kino, "Strip Coupled Acoustic Convolvers," 1973 *Ultrasonics Symposium Proceedings,* IEEE Cat. No. 73 CHO 807-9SU, pages 145–147.

While the mechanical contact model for a multistrip coupled convolver offers some advantages over air gap devices, the most promising possiblity for the utilization of the multistrip coupled concept for convolvers is in its application to monolithic structures where the piezoelectric and semiconductor media are films deposited side by side on the same crystalline substrate. This approach has the advantage of enabling the fabrication of convolver devices to close tolerances in production quantities by the well established and relatively inexpensive lithographic techniques currently in use for the manufacture of integrated circuits.

Monolithic multistrip coupled convolvers are discussed by the inventor of the present invention in L. R. Adkins, "Strip Coupled AlN and Si on Sapphire Convolvers," 1973 *Ultrasonics Symposium Proceedings,* IEEE Cat. No. 73 CHO 857-8SU, pages 148–151 and in L. R. Adkins, "Monolithic Aluminum Nitride/Silicon-on-Sapphire Strip Coupled Convolvers," 1974 *Ultrasonics Symposium Proceedings,* IEEE Cat. No. 74 CHO 896-1SU, pages 228–231. A use for a multistrip coupled convolver is disclosed in "Monolithic Acousto-electric Image Pick-up Device", U.S. Pat. No. 3,970,778, issued to L. R. Adkins on July 20, 1976, and assigned to the assignee of the present application.

The use of an array of interdigital transducer taps distributed along the interaction region, or propagation path, of a surface acoustic wave delay line and connected individually to parallel or series connected diodes for nonlinear signal mixing is illustrated in Reeder et al, "Diode Coupled Tapped Acoustic Delay Line Correlator and Convolver," U.S. Pat. No. 4,016,514 issued Apr. 5, 1977.

Throughout this specification, the use of the terms "coupler means" and "coupler", unless further limited, are intended to refer equally to arrays of interdigital transducers, to multistrip couplers and to their equivalents.

A comparison of the performance of several types of convolvers is given in O. W. Otto, "Theoretical Comparison of Space-Charge-Enhanced Acoustic Surface Wave Convolvers," *Proceedings of Symposium on Optical and Acoustical Micro-Electronics,* New York, Polytechnic Press. 1975, pp 511–528. Acoustic surface wave convolvers having space-charge-enhancement means therein include combined media convolvers, separated media convolvers, strip coupled convolvers, and parallel and series diode convolvers.

A principal figure of merit for a convolver is its time-bandwidth product (TB). For signal processing applications, it is desirable to have TB as large as is practicable because TB is a measure of the amount of information that a device or system can process. It will be apparent to those skilled in the art that, in a surface acoustic wave convolver, TB is proportional to the distance between the surface acoustic wave input transducers or, equivalently, to the length of the propagation path for counter-propagating surface acoustic waves. The greater is this distance, the greater will be TB. However, in a prior-art single-channel convolver, wherein coupling means such as an array of interdigital transducer taps or a multistrip coupler is disposed over substantially all of the propagation path, the propagation path cannot be extended indefinitely without incurring penalties.

If the propagation path is lengthened, and thus the coupling means is lengthened also, problems may arise because of the presence of an increased amount of conductor material overlying the piezoelectric material. Unwanted dispersion and reflection, or scatterings, effects are increased by this additional conductor material. Losses are also increased.

In addition, a requirement for the fabrication of a single-channel coupler extending over a relatively long propagation path is likely to exceed the upper size limitations of currently available lithographic fabrication facilities and techniques. The development of contemporary lithography has been pressed by a desire to make electronic devices smaller, not larger

SUMMARY OF THE INVENTION

The invention is an acousto-electric convolver of the type wherein electric field variations associated with surface acoustic waves counter-propagating on piezoelectric material are coupled into space-charge-enhancement means disposed at a substantial distance from the interaction region for the surface acoustic waves. This description includes multistrip coupled convolvers and parallel and series diode convolvers. A plurality of similar single-channel acousto-electric convolvers of this type are interconnected in parallel to form a multiple-channel convolver. The coupling means for subjecting the space-charge-enhancement means to electric field variations occurring at the interaction region is distributed over the plurality of single-channel convolvers. The coupler for each distinct single-channel convolver extends over a segment of the propagation path of that convolver. A segment is shorter than the full propagation path. The distribution of the coupler means in such segments over the propagation paths of the plurality of single channel convolvers is preferably such that the equivalent of a full interaction region is coupled to the space-charge-enhancement means.

Since there is no inherent limitation on the number of single-channel convolvers which may be combined to form the multiple-channel convolver in accordance with this invention, as many single-channel convolvers may be so combined as is desired or as is practicable. Each distinct single-channel convolver is so fabricated that only a portion of its interaction region is associated with space-charge-enhancement means by coupler means. Even though the full propagation paths on the single-channel convolvers may be relatively long, the portion, or segment, of the propagation path on each single-channel convolver associated with a coupler may be relatively short.

In the preferred embodiment, an output signal equivalent to that associated with a single complete propagation path is obtained by combining, or summing, the electric field variation effects of the plurality of interconnected single-channel convolvers. Thus, the equivalent propagation path of the multiple-channel convolver may be made relatively long by making the length of the propagation path on each of the plurality of single-channel convolvers a desired long length. The resulting multiple-channel convolver will have a corresponding relatively large time-bandwidth product. However, since each of the plurality of single-channel convolvers may have a relatively short coupler disposed thereon, the fabrication difficulties encountered when long couplers are attempted to be made are avoided. The dispersion effects, reflection effects, and losses resulting from the use of relatively long couplers on a single propagation path are also avoided.

DESCRIPTION OF THE PREFERRED EMBODIMENTS

Figure 1:
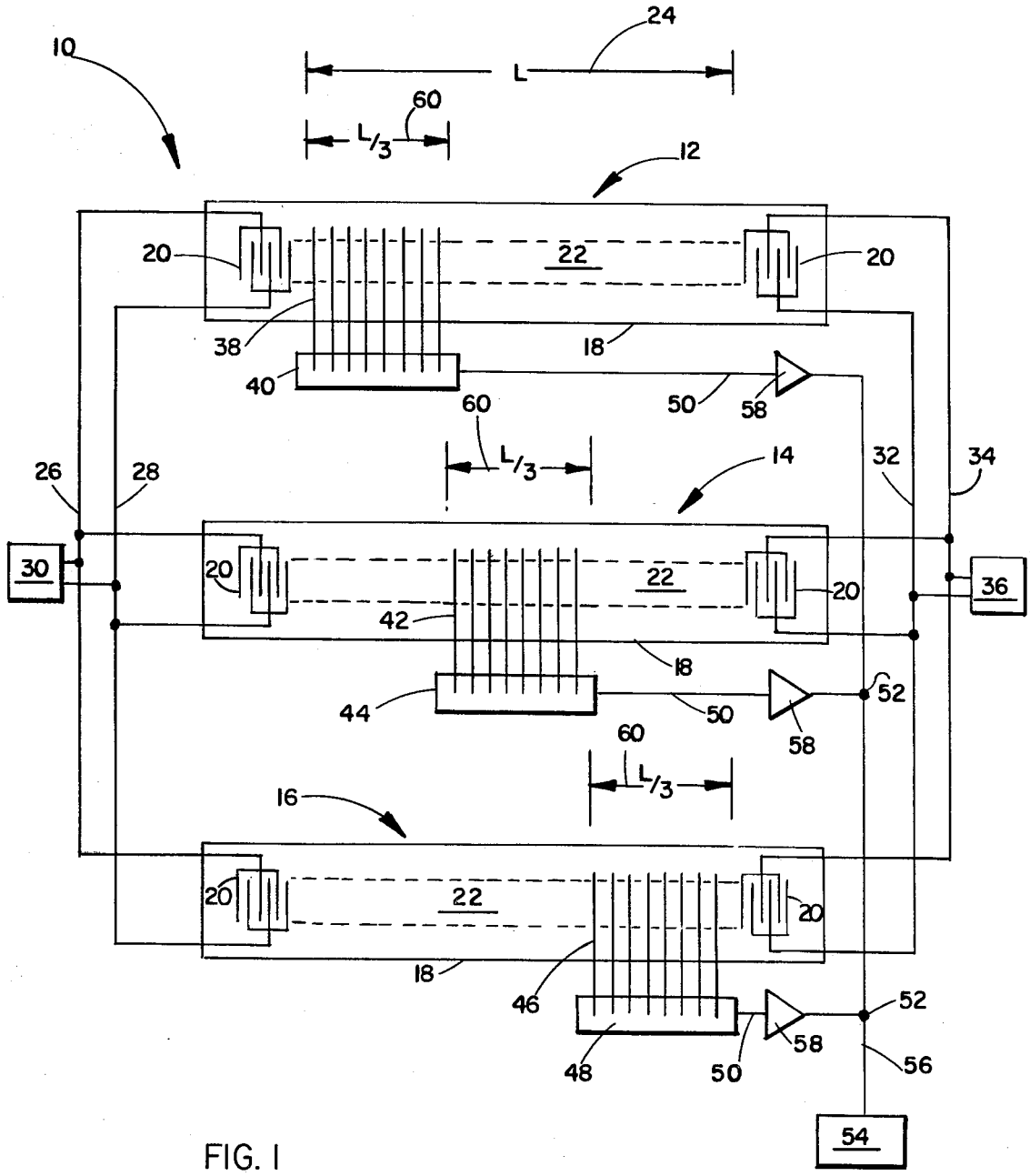
FIG. 1 is a schematic representation of a multiple-channel acoust0-electric convolver according to the present invention wherein multistrip couplers transfer the effects of electric field variations into space-charge-enhancement means.

FIG. 1 illustrates the invention by showing a multiple-channel acousto-electric convolver 10 implemented by interconnecting three similar single-channel multistrip coupled convolvers 12, 14, and 16 in parallel. Three single-channel convolvers are shown in the embodiment of FIG. 1 for the purpose of illustration only. As few as two or a great many of such single-channel convolvers may be interconnected to form a multiple-channel convolver in accordance with the invention.

Each of the similar single-channel convolvers 12, 14, and 16 comprises a substantially planar body 18 of piezoelectric material of, for example, quartz or aluminum nitride. Two input interdigital transducers 20 for launching surface acoustic waves are disposed on each body 18 of piezoelectric material, one each near the opposite ends of a propagation path 22 on the body 18 for counter-propagating surface acoustic waves. Propagation path 22 or, equivalently, interaction region 22 is shown as the region lying between the dashed lines extending between the transducers 20 on each of convolvers 12, 14 and 16. The propagation paths 22 each have substantially the same length, L, as indicated by double-ended arrow 24. The length, L, is selected to be as large as is required to provide the desired time-bandwidth product for the multiple-channel convolver 10.

All of the input interdigital transducers 20 at the left sides of single-channel convolvers 12, 14, and 16 are interconnected in parallel by wire pair 26,28 to signal input source 30. All of the input interdigital transducers 20 at the right sides of single-channel convolvers 12, 14, and 16 are interconnected in parallel by wire pair 32,34 to signal input source 36.

Single-channel convolvers 12, 14, and 16 each include multistrip couplers 38, 42, and 46, respectively, for transferring, or coupling, electric field variations occurring in the interaction regions 22 into bodies 40, 44 and 48, respectively, of semiconductor material. Bodies 40, 44 and 48 of semiconductor material are each disposed at a convenient distance away from the propagation paths 22 with which they are individually associated. The output voltages which are thus induced across bodies 40, 44, and 48 of semiconductor material are each coupled to an output circuit 50. The several output circuits 50 are interconnected in parallel to sum the individual output voltages at junctions 52. The summation voltage is then provided to a load 54 by means of a circuit 56. Buffer amplifiers 58, coupled between the output circuits 50 and the junctions 52 may be included, if necessary, to provide impedance matching and phase adjustment.

The multiple-channel convolver 10 shown in FIG. 1 is designed to provide a summation voltage to the load 54 which has a time-bandwidth product the equivalent of that which would be provided by a single-channel multistrip coupled convolver wherein both the propagation path and the multistrip coupler have a length L. In the multiple-channel convolver 10, this result is achieved by distributing three substantially equal-length multistrip couplers 38, 42, and 46 over selected segments of the propagation paths 22 on each of the single-channel convolvers 12, 14, and 16. These three equal-length multistrip couplers 38, 42, and 46 each have a length of L/3, as indicated by double-ended arrow 60. The sum of the lengths of multistrip couplers 38, 42, and 46 is equal to the equivalent path length, L, desired for the multiple-channel convolver 10.

The position distribution of the multistrip couplers 38, 42, and 46, as shown in FIG. 1, is also selected to provide a summation voltage which is the equivalent of that of a single-channel convolver wherein the propagation path length and multistrip coupler length are the same length L. This may be understood by recognizing that the group of three multistrip couplers 38, 42, and 46 may be regarded as equivalent to a single coupler of length L which happens to be distributed over three equivalent propagation paths. The equivalence of the three smaller couplers 38, 42, and 46 to a single longer coupler is preserved by distributing the smaller couplers on selected segments of their respective propagation paths in such a manner that electric field variations corresponding to any one small region on the equivalent propagation path are sensed once and only once by only one of the group of smaller couplers. Stated alternatively, the multistrip couplers 38, 42, and 46 are disposed on their respective propagation paths 22 without either overlaps or gaps in their equivalent composite function.

It is appropriate to note here that each of the group of multistrip couplers need not be continuous and yet an equivalent result may be obtained. For example, rather than providing electric field coupling for the entire central third of the propagation path 22, the multistrip coupler 42 for single-channel convolver 14 could be disposed in three separate segments to provide coupling for the central third of each third of a propagation path 22. Correspondingly, multistrip couplers 38 and 46 could be disposed in three separate segments each to provide coupling for the leftmost and rightmost thirds, respectively, of each third of a propagation path 22.

It is also appropriate to note here that the invention is not restricted to one wherein the parameters of the group of couplers are limited as has been described hereinabove for the preferred embodiment. Individual couplers in the group need not always be equal in length to the others. So long as the sum of the lengths is equal to L, the equivalence to a single coupler of length L may be made to hold. Even this limitation may not always be necessary or desirable inasmuch as useful signal processing may be accomplished in a multiple-channel acousto-electric device as described herein wherein individual couplers having a length less than L are distributed over the several propagation paths of a multiple-channel device in such a way that electric field variations at corresponding points on a plurality of propagation paths are sensed by more than one coupler, creating an overlap, by no coupler at all, creating a gap, and by couplers distributed to create a combination of these effects. Even in the absence of overlaps and gaps, combinations of couplers forming devices having an equivalent path length less than the full length, L, of the propagation path may be readily formed and used where desirable.

Figure 2:
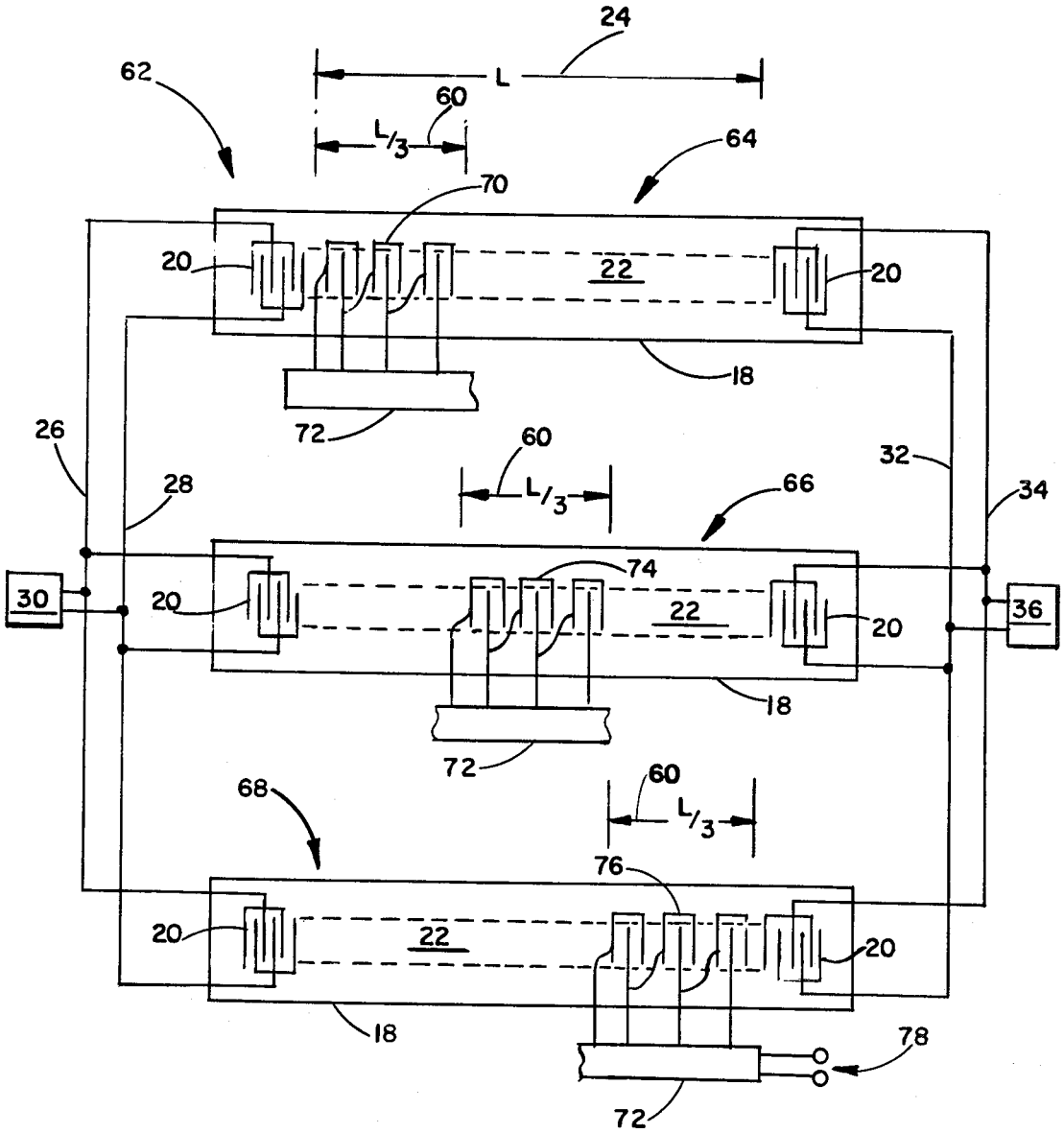
FIG. 2 is a schematic representation of a multiple-channel acousto-electric convolver according to the present invention wherein interdigital transducer taps transfer the effects of electric field variations into space-charge-enhancement means.

FIG. 2 illustrates the invention by showing a multiple-channel acousto-electric convolver 62 implemented by interconnecting three similar single-channel diode convolvers 64, 66, and 68 in parallel. Diode convolvers, both series and parallel types, are discussed in detail in the aforementioned patent to Reeder et al, U.S. Pat. No. 4,016,514, which is hereby incorporated by reference into this specification for the purpose of providing details of diode convolver construction.

Single-channel convolvers 64, 66, and 68 comprise substantially planar bodies 18 of piezoelectric material and input interdigital transducers 20 for launching counter-propagating surface acoustic waves along propagation paths 22 on the bodies 18. The propagation paths 22 each have substantially the same length, L, as indicated by double-ended arrow 24, in the preferred embodiment. The length, L, is selected to be as large as is required to provide the desired time-bandwidth product for the multiple-channel convolver 62.

The input interdigital transducers 20 of the left sides of single-channel convolvers 64, 66, and 68 are interconnected in parallel by wire pair 26,28 to signal input source 30. The input interdigital transducers 20 at the right sides of single-channel convolvers 64, 66, and 68 are interconnected by wire pair 32,34 to signal input source 36.

Single-channel convolvers 64, 66, and 68 each include an array of interdigital transducer taps 70, 74, and 76, respectively, for transferring, or coupling, electric field variations occurring in the interaction regions 22 into space-charge-enhancement means 72. In diode convolvers, space-charge-enhancement is provided by at least one array of forward biased semiconductor diodes interconnected either in series or in parallel. The network of diode convolvers is interconnected with the arrays of interdigital transducer taps 70, 74, and 76 to provide nonlinear signal mixing and summing of the electric field variation effects of the plurality of single-channel convolvers 64, 66, and 68 to form a combined output signal for the multiple-channel convolver 62. The array of diodes and these interconnections, along with an output port 78, are indicated generally in FIG. 2 as contained in the box 72. For details of the interconnection of the interdigital transducers and the diodes, see FIGS. 1 and 2 of the aforementioned patent to Reeder et al wherein FIG. 1 shows series-connected diode space-charge-enhancement means and FIG. 2 shows parallel-connected diode space-charge-enhancement means.

The box 72 is shown broken apart in FIG. 2 of the present disclosure for convenience in illustrating parallel interconnection of a diode network and output port 78 with an array 70 of interdigital transducer taps spanning the leftmost third of the propagation path 22 on single-channel convolver 64, with an array 74 of interdigital transducer taps spanning the center third of the propagation path 22 on single-channel convolver 66, and with an array 76 of interdigital transducer taps spanning the rightmost third of the propagation path 22 on single-channel convolver 68. The position distribution of the interdigital transducer arrays 70, 74, and 76, as shown in FIG. 2, is preferably selected to supply a summed output voltage for the entire convolver 62 which is the equivalent of that of a single-channel convolver wherein the propagation path length and the length of the array of interdigital transducer taps associated therewith are the same length L. In the preferred embodiment shown in FIG. 2, the single-channel convolvers 64, 66, and 68 have arrays of interdigital transducer taps 70, 74, and 76, respectively, which are of equal length L/3 as indicated by the double-ended arrows 60.

It will be apparent to those skilled in the art that the same considerations apply regarding variations in the manner in which interdigital transducer taps may be distributed over a plurality of single-channel diode convolvers as were discussed in connection with multistrip coupled convolvers hereinabove.

While the invention has been described in its preferred embodiments, it is understood that the words which have been used are words of description rather than of limitation and than changes within the purview of the appended claims may be made without departing from the true scope and spirit of the invention in its broader aspects.

What is claimed is:

1. A multiple-channel acousto-electric convolver, comprising:

(a) a plurality of single-channel acousto-electric convolvers having their first input interdigital transducers connected in parallel and their second input interdigital transducers connected in parallel; each of said single-channel convolvers comprising:

(1) a body of piezoelectric material for inducing electric field variations along a propagation path thereon for counter-propagating surface acoustic waves, said propagation path having a selected length;

(2) space-charge-enhancement means for interacting with said electric field variations; and (3) coupler means for sensing said electric field variations and coupling them into said space-charge-enhancement means, wherein said coupler means is disposed over a segment of said propagation path, wherein said segment has a length less than said selected propagation path length, and wherein said segment for each single-channel convolver is positioned on said body relative to the ends of said propagation path sufficiently offset from the relative segment position for each remaining single-channel convolver in said plurality of single-channel convolvers that electric field variations sensed by said coupling means on any one single-channel convolver differ significantly from those sensed on any other of said plurality of single-channel convolvers; and (b) means for combining the effects of said electric field variations on said space-charge-enhancement means of said plurality of single-channel convolvers in a single output signal.

2. A multiple-channel acousto-electric convolver as recited in claim 1 wherein said selected length of said propagation path is the same for each of said plurality of similar single-channel acousto-electric convolvers.

3. A multiple-channel acousto-electric convolver as recited in claim 2 wherein said length of said segment of said propagation path is the same for each of said plurality of similar single-channel acousto-electric convolvers.

4. A multiple-channel acousto-electric convolver as recited in claim 3 wherein a distribution for disposing said coupling means over said segments of said plurality of propagation paths is selected to provide said multiple-channel convolver with an effective propagation path length greater than said length of any one of said segments.

5. A multiple-channel acousto-electric convolver as recited in claim 4 wherein said effective propagation path length is substantially equal to said selected propagation path length.

6. A multiple-channel acousto-electric convolver as recited in claim 1 wherein said space-charge-enhancement means comprises a body of semiconductor material and wherein said coupler means is a multistrip coupler.

7. A multiple-channel acousto-electric convolver as recited in claim 1 wherein said space-charge-enhancement means comprises an array of interconnected diodes and wherein said coupler means is an array of interdigital transducer taps.

8. A multiple-channel acousto-electric convolver as recited in claim 1, further comprising output means for an output signal in which is combined the effects of said electric field variations as coupled into said space-charge-enhancement means for said plurality of similar single-channel acousto-electric convolvers.

* * * * *